United States Patent [19]

Somov et al.

[11] 3,958,438

[45] May 25, 1976

[54] APPARATUS FOR BENDING PIPES WITH HEATING OF THE BENDING ZONE

[76] Inventors: Boris Stepanovich Somov, ulitsa Krasnykh Partizan, 3, kv. 22; Alexandr Ilich Mamin, ulitsa Kirovogradskaya, 69a, kv. 5; Andrei Porfirievich Novikov, ulitsa Sotsialisticheskaya, 7, kv. 13; Vyacheslav Ivanovich Filippov, ulitsa Polzunova, 24, kv. 1; Sergei Grigorievich Khirdzhiev, ulitsa Bakinskikh Komissarov, 58, kv. 48, all of Sverdlovsk; Vladimir Zakharovich Gurevich, Yasny proezd, 4, korpus 1, kv. 20, Moscow; Nikolai Stepanovich Voronov, ulitsa Bogdana Khmelnitskogo, 68, kv. 18; Ivan Fedorovich Agafonov, ulitsa Bogdana Khmelnitskogo, 101, kv. 69, both of Belgorod, all of U.S.S.R.

[22] Filed: Oct. 4, 1974

[21] Appl. No.: 512,153

[52] U.S. Cl. ..... 72/128; 72/342

[51] Int. Cl.[2] ..... B21D 7/16

[58] Field of Search ..... 72/128, 342; 219/7.5, 219/8.5, 153, 154

[56] References Cited

UNITED STATES PATENTS

| | | | |
|---|---|---|---|
| 2,206,519 | 7/1940 | Taylor | 72/128 |
| 2,357,006 | 8/1944 | Johnson | 72/128 |
| 2,480,315 | 8/1949 | Bennett | 219/153 |

*Primary Examiner*—Lowell A. Larson
*Attorney, Agent, or Firm*—Holman & Stern

[57] ABSTRACT

Apparatus for bending pipes is disclosed including a bed supporting the pipe to be bent; a clamping bending head rotatably mounted on the bed in the bending plane; longitudinal guides on the bed and a heater mounted on those longitudinal guides. A first hydraulic cylinder mounted on the bed to move the heater over the guides and a further hydraulic cylinder to longitudinally feed the pipe during the process of bending.

3 Claims, 6 Drawing Figures

APPARATUS FOR BENDING PIPES WITH HEATING OF THE BENDING ZONE

BACKGROUND OF THE INVENTION

The invention relates to an apparatus of bending pipes with local heating.

Known widely at present are the methods of heating pipes with local heating of the bending zone, realized with the aid of devices whose operating element constitutes a bending head which is rotatable in the bending plane, and which clamps one end of the pipe to be bent.

The most general practice is to place the pipe on the bed of the device, moving it at once to the stop in the bending head, and to clamp it there before the beginning of bending, i.e. before applying the bending and upsetting forces to the pipe.

When the pipe is bent with upsetting, the bending force is applied to the other end of the pipe, acting on the appropriate end of the pipe by means of hydraulic cylinders which feed said pipe longitudinally towards the bending head.

The pipe zone to be bent is heated by a circular heater, e.g. a H.F. inductor secured immovably to the bed of the device in the pipe-bending zone.

In view of the fact that bending of the pipe commences only after the heated zone reaches the temperature required for bending, the pipe and the heater remain for a certain period immovable relative to each other unitl bending begins. It has been proved in practice that a part of the heated zone located just behind the heater (looking from the bending head) becomes overheated within this period of time. This leads to uneven deformation of the pipe walls along the width of the heated zone and, as a consequence, to variations in the thickness and strength of the pipe manifested by corrugations or wrinkles in this part of the heated zone.

To counter the above-mentioned disadvantages, in recent times there has been a suggestion to bend the pipe with the aid of the same devices that are described above, but to place the pipe on the bed of the device so that in the initial position said pipe comes short of the stop in the bending head and remains unclamped in it until the actual process of bending begins. When the heater is switched on, the pipe is simultaneously loaded by a force insuring a free feed of the pipe to the stop of the bending head and, consequently, movement of the pipe relative to the heater. The period of time within which the front end of the pipe moves to the stop of the bending head is sufficient for stabilizing the temperature and width of the heated zone. Then the bending force is applied to the pipe (see, for example, Pat. No. 1,935,100, Cl.N21d-9-18, Federal Republic of Germany).

This method involves considerable difficulties consisting in the need for the operator to determine the moment when the front end of the pipe comes to the stop of the bending head in order to be able to clamp in due time the corresponding end of the pipe in the bending head.

This moment corresponds to the instantaneous stopping of the longitudinal movement of the pipe which precedes bending.

In addition to the difficulties in determining the moment of clamping the pipe in the bending head, a dangerous situation may arise because it becomes impossible to close the cover of the bending head if the moment of it clamping is missed.

Furthermore, clamping of the pipes under these conditions always results in considerable damage, i.e. deep dents produced on the pipe walls by the bending head clamps because the pipe in this method is always more or less cocked in the bending head just before clamping.

SUMMARY OF THE INVENTION

The main object of the invention is to provide an apparatus for bending pipes with local heating which would ensure optimum pipe-bending conditions.

Furthermore, other objects of the invention are: to avoid non-uniformity in heating the bending zone in width and, as a consequence, to eliminate the resultant variations in the thickness and strength of the pipe walls in the bending zone; to avoid wrinkling of pipes; simplify the method and make it safer; to eliminate cocking of the pipe in the bending head and resultant damaging and denting of the pipe by the clamps of the bending head.

Other objects and advantages of the invention will become apparent from the description that follows.

These objects are achieved by providing a method of pipe bending with heating of the bending zone by a heater and with a relative movement of the pipe and heater up to the moment when the temperature and width of the heated pipe zone become stable wherein, according to the invention, the heater is moved relative to the immovable pipe and, as the heater stops, the pipe is subjected to bending forces.

In accordance with the above method we provide a device for bending pipes with heating of the bending zone, comprising a bed which supports the pipe to be bent and mounts a clamping bending head rotatable in the bending plane, hydraulic cylinders insuring the longitudinal feed of the pipe, and a heater wherein, according to the invention, the heater is installed in guides which are arranged longitudinally relative to the bed and there is a hydraulic cylinder intended to move the heater over said guides.

To ensure more reliable equalizing of the moving speeds of the heater and pipe, it is practicable that the hydraulic cylinder which moves the heater should be connected to the hydraulic system of the hydraulic cylinders ensuring longitudinal feed of the pipe being bent, in which case the working area of the piston in the hydraulic cylinder for moving the heater is equal to the sum of working areas of the pistons in the longitudinal feed hydraulic cylinders.

Now the invention will be described in detail by way of example with reference to the accompanying drawings in which:

DETAILED DESCRIPTION OF THE PREFERRED EMBODIMENTS

Figure 6:
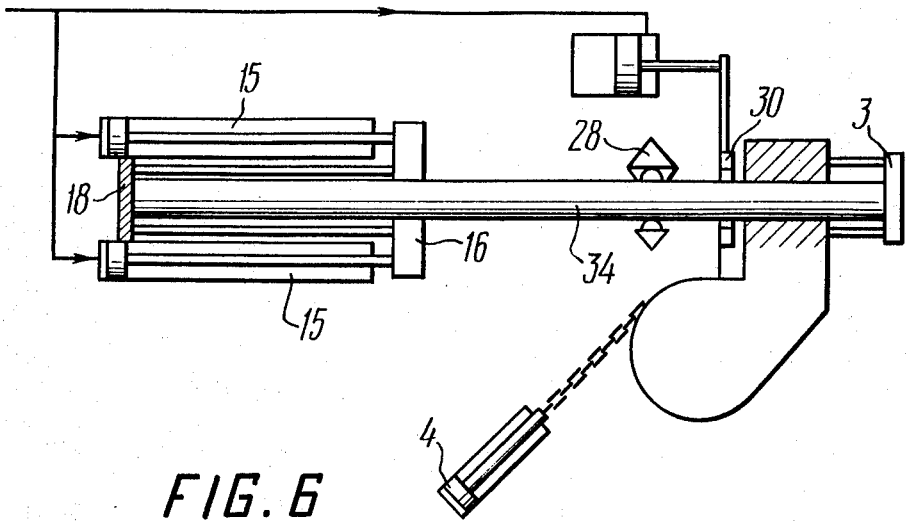
FIG. 6 shows the hydraulic control system of the hydraulic cylinders for longitudinal feed of the pipe and heater.

The device comprises a bed 1 (FIGS. 1 and 2) which supports a clamping bending head 2 in front, rotatable horizontally and provided with a stop 3 (FIGS. 1, 2 and 6) for the corresponding end of the pipe to be bent; a brake hydraulic cylinder 4 (FIGS. 1,6) which retards the turning of the bending head in the course of pipe bending; a hydraulic cylinder 5 (FIG. 1) intended to return the bending head 2 to the initial position after bending.

The pipe is clamped in the bending head 2 by means of a swivelling cover 6 (FIG. 2) operated by a hydraulic cylinder 7. To ensure reliable fastening of the pipe in the bending head 2, the cover 6 is clamped additionally by an eccentric lever 8; the latter is turned by a drive 9 of its own.

The bending head 2 is turned in the horizontal direction corresponding to the pipe-bending plane because the body of said head 2 is installed on a carrier 10 (FIG. 1) which is mounted on a horizontally-rotatable slide 11.

Figure 2:
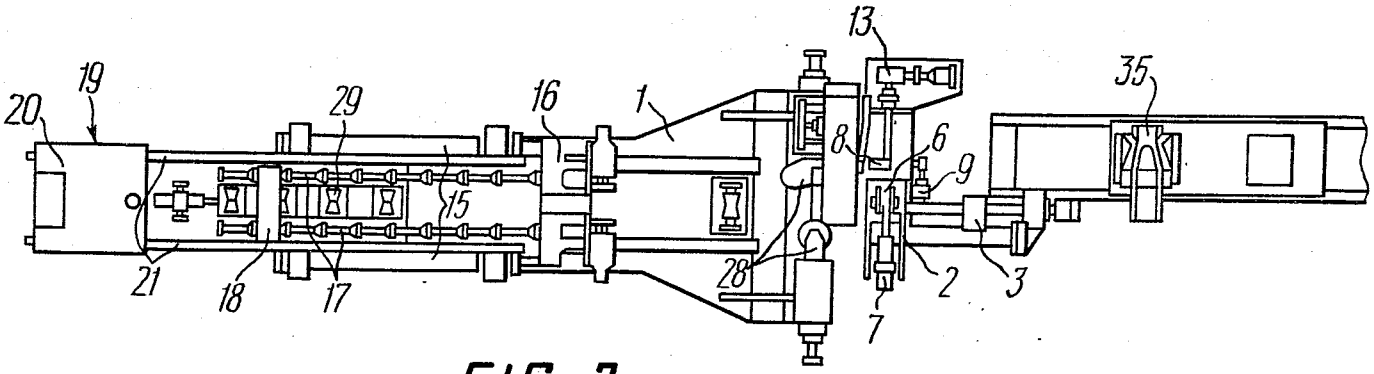
FIG. 2 shows the plan view of the same device.

The bending head 2 is installed on the carrier in guides 12 arranged across the bed 1; the head 2 is moved in the guides by a drive 13 (FIG. 2).

The slide 11 is, in turn, mounted on the bed 1 in its own guides 14 (FIG. 1) which are also arranged across the bed 1. The slide is moved in these guides by a special drive (not shown in the drawing). The transverse movements of the slide 11 and bending head 2 ensure their setting for the predetermined bending radius.

The rear part of the bed 1 mounts the mechanism for longitudinal feed of the pipe towards the bending head. This mechanism comprises hydraulic cylinders 15 (FIGS. 2, 6) for the longitudinal feed of the pipe and a crosspiece 16 (FIGS. 1 and 2) rigidly connected with the rods of the hydraulic cylinders 15. Connected rigidly to the rear face of the crosspiece 16 are stepped rods 17 whose hollows accommodate a stop 18 (FIGS. 2 and 6) which is also included in the longitudinal feed mechanism and transmits the force of the hydraulic cylinders 15 to the rear end of the pipe.

The same rear part of the bed supports a mechanism 19 (FIGS. 1 and 2) for installing the stop 18 into the corresponding stepped hollows of the rods 17 to suit the length of the pipe being bent.

Figure 5:
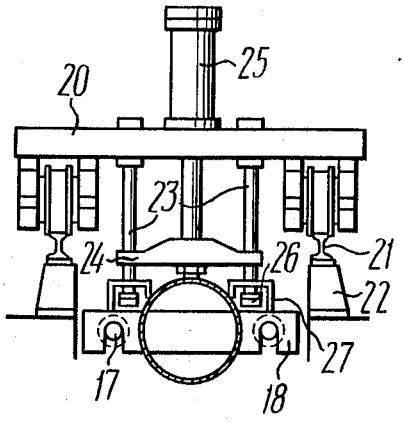
FIG. 5 is a view along arrow "C" in FIG. 1, enlarged.

The mechanism 19 (FIG. 5) consists of a trolley 20 (FIGS. 1, 2 and 5) moving over guide rails 21 which are secured along the bed 1 by means of brackets 22 (FIG. 5). The trolley 20 has rods 23 which connect said trolley via a crosspiece 24 with the rod of a hydraulic cylinder 25. The lower ends of the rods 23 carry levers 26 which engage shackles 27 secured to the stop 18. When the crosspiece 24 is lifted by the hydraulic cylinder 25, the stop 18 rises too, disengages the stepped hollows of the rods 17 and thus allows the trolley 20 to be moved over the guide rails 21 along the bed 1 and stopped at the required point of said guide rails 21. The stop 18 moves together with the trolley along the rods 17.

When the crosspiece 24 is lowered, the stop 18 engages the stepped hollows of the rods 17.

Figure 4:
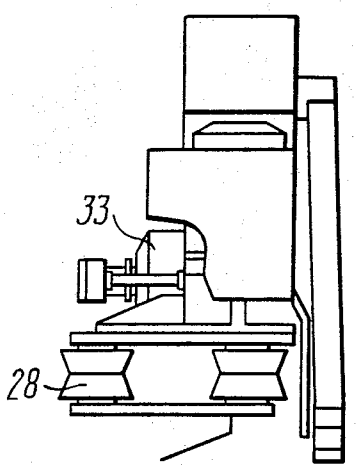
FIG. 4 is a view along arrow "B" in FIG. 3.

The front part of the bed 1 mounts supporting rollers 28 (FIGS. 2 and 4) intended for taking the moment created by the forces applied to the pipe being bent and for initial alignment of the pipe relative to the heater.

Built into the rear part of the bed 1 is a power-operated roller bed 29 (FIGS. 1 and 2) which supports the rear end of the pipe as it is fed towards the bending heat.

Figure 3:
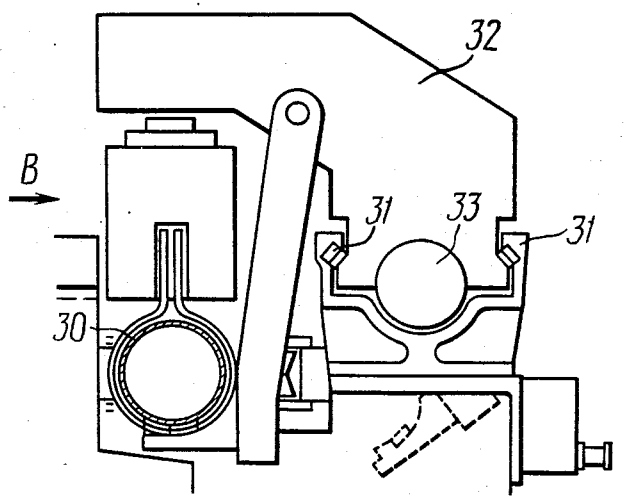
FIG. 3 is a view along arrow "A" in FIG. 1, enlarged.

The heater for heating the pipe zone, e.g. a H.F. inductor 30, (FIG. 3) is installed on guides 31 which are arranged longitudinally along the bed; the inductor 30 is secured by means of an L-shaped slide 32 (FIGS. 1 and 3) rigidly connected with a hydraulic cylinder 33 (FIGS. 3 and 4) which insures movement of the slide 32 and the heater over the guides 31.

Here we disclose the most practicable version of the bending device wherein the hydraulic cylinder 33 for longitudinal movement of the heater is included into the general hydraulic control system which comprises the longitudinal feed hydraulic cylinders 15; the working area of the piston in the hydraulic cylinder 33 is equal to the sum of working areas of the hydraulic cylinders 15.

Such an arrangement allows one and the same hydraulic drive to be used first for free movement of the heater relative to the immovable pipe then for working movement of the pipe relative to the immovable heater, the speed of both movements being equal.

Besides, this simplifies the design and operation of the entire device as compared with the version incorporating an individual drive for the hydraulic cylinder 33.

Bending of pipes on the above-described device is carried out as follows.

The pipe 34 to be bent (FIG. 6) is placed by a crane on the roller bed 29 and on the movable crosspiece 16 which is open on the top so that the front end of the pipe is located close to the supporting rollers 28 which rules out additional movement of the pipe along the axis of the bed. The movable crosspiece 16 is at this moment in the rearmost position near the faces of the longitudinal feed hydraulic cylinders 15. The pipe is gripped by the clamping device located on the front wall of the movable crosspiece. Pressure is fed into the piston spaces of the hydraulic cylinders 15 and the crosspiece 16 moves together with the pipe forward between the supporting rollers 28. The rollers are brought towards each other by hydraulic motors and a screw-and-nut drive (not shown in the drawing) and center the pipe before feeding it into the inductor 30 and bending head 2. Further movement of the movable crosspiece 16 pushes the pipe 34 through the supporting rollers 28 and heater 30 until said pipe comes in contact with the stop 3 of the bending head 2. Then the pipe is released in the crosspiece 16 and the latter is withdrawn by the hydraulic cylinders 15 to the rearmost position.

The stop 18 is set in the corresponding stepped hollows of the rods 17 by means of the above-described mechanism so as to bring it in contact with the rear end of the pipe 34.

Now the slide 32 is moved by the hydraulic cylinder 33 along the guides 31 to the foremost position near the bending head 2.

The front end of the pipe 34 is clamped in the bending head 2, the inductor 30 is switched on and the hydraulic pump (not shown in the drawing) starts the supply of working fluid into the working spaces of the hydraulic cylinders 15 and 33. Simultaneously, the working fluid is supplied into the rod chambers of the brake hydraulic cylinder 4 and of the cylinder 5 which returns the bending head to its initial position.

Inasmuch as the bending zone of the pipe is not yet heated at the beginning of hydraulic pump operation and offers a high resistance to axial compression, the working fluid from the hydraulic pump is delivered to the hydraulic cylinder 33 which causes the slide 32 with the inductor 30 to move over the guides 31 along the pipe 34.

While the inductor moves along the pipe from the foremost to the rearmost position, the temperature and width of the bending zone being heated become stabilized. When the inductor 30 comes to the rearmost position which is accompanied by stopping of the piston of the hydraulic cylinder 33 in the extreme position, the working fluid begins to be delivered from the pump to the longitudinal feed hydraulic cylinders 15 moving the pipe longitudinally forward during the bending process. The bending zone of the pipe is sufficiently heated by this time and the pipe begins to be bent which is accompanied by turning of the bending head 2 through a predetermined angle. Due to uniform and stable heating, the pipe is bent with uniform upsetting and without wrinkles. On completion of bending, the inductor 30 and hydraulic pump are switched off; the stop 3 of the bending head 2 is withdrawn from the front end of the pipe, the bending head cover is unlocked and opened.

Figure 1:
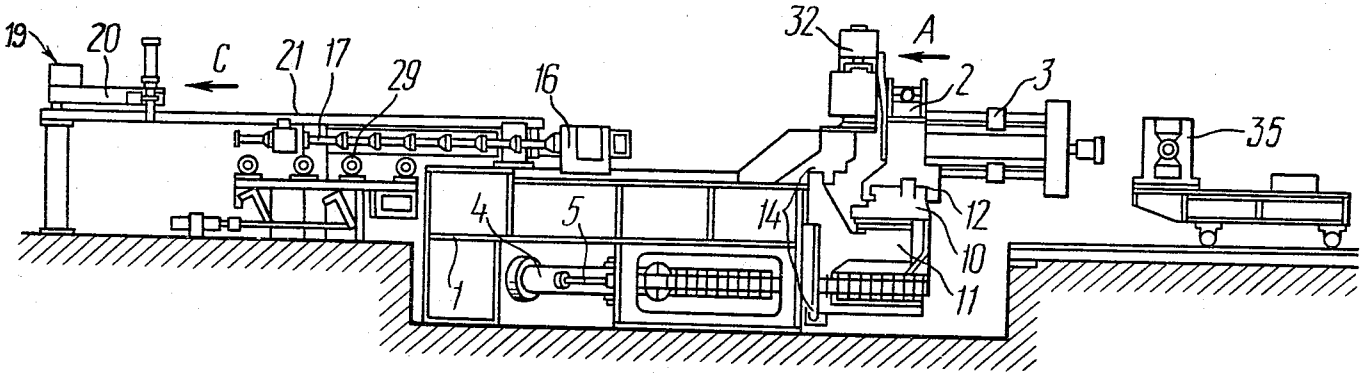
FIG. 1 is a general side view of the device for bending pipes with heating of the bending zone according to the invention.

The movable crosspiece 16 operated by the hydraulic cylinders 15 pushes the pipe 34 through the supporting rollers 28 into the grip of the retracting mechanism 35 (FIGS. 1 and 2). The retracting mechanism is not considered in detail here since it is a well known construction. Then the supporting rollers 28 are spread apart, the pipe is completely released and taken off the roller bed 29 by the above-mentioned retracting mechanism. The bending head is turned by the brake hydraulic cylinder 4 to the initial position. The hydraulic cylinders 15 move the crosspiece 16 and stop 18 to the rearmost positions. This completes the process of bending.

We claim:

1. An apparatus for bending pipes comprising: a bed supporting the pipe to be bent; a clamping bending head rotatably mounted on the bed in the bending plane; longitudinal guides on the bed; a heater mounted in these longitudinal guides; a first hydraulic cylinder mounted on the bed for moving said heater over said guides; and at least one further hydraulic cylinder for longitudinally feeding the pipe during the process of bending.

2. The apparatus according to claim 1 wherein the first hydraulic cylinder having a piston is connected to a hydraulic system, which system also is connected to said further hydraulic cylinder having at least one piston, the working area of the piston in the first hydraulic cylinder being equal to the working area in the further hydraulic cylinder.

3. The apparatus as claimed in claim 2, wherein there are a plurality of further hydraulic cylinders each having a piston and the sum of the working areas of the pistons in said further hydrualic cylinders is equal to the working area of the piston in said first hydraulic cylinder.

* * * * *